US007653319B2

(12) United States Patent
Yamamoto et al.

(10) Patent No.: US 7,653,319 B2
(45) Date of Patent: Jan. 26, 2010

(54) IMAGE FORMING APPARATUS THAT ADDS A TONER IMAGE TO A NON-IMAGE AREA OF A PHOTORECEPTOR TO PREVENT WARPING OF CLEANING BLADE

(75) Inventors: Masanobu Yamamoto, Nara (JP); Susumu Murakami, Kyoto (JP)

(73) Assignee: Sharp Kabushiki Kaisha, Osaka-shi, Osaka (JP)

( * ) Notice: Subject to any disclaimer, the term of this patent is extended or adjusted under 35 U.S.C. 154(b) by 408 days.

(21) Appl. No.: 11/284,844

(22) Filed: Nov. 23, 2005

(65) Prior Publication Data

US 2006/0110173 A1 May 25, 2006

(30) Foreign Application Priority Data

Nov. 25, 2004 (JP) ..... 2004-340586

(51) Int. Cl.
*G03G 15/00* (2006.01)

(52) U.S. Cl. ..... 399/44; 399/51; 399/97; 399/343; 399/350

(58) Field of Classification Search ..... 399/44, 399/51, 97, 343, 350
See application file for complete search history.

(56) References Cited

U.S. PATENT DOCUMENTS 5,107,285 A * 4/1992 Hamada et al. ..... 399/169
5,881,339 A * 3/1999 Yanagida et al. ..... 399/44

FOREIGN PATENT DOCUMENTS

| | | |
|---|---|---|
| JP | 1-229281 A | 9/1989 |
| JP | 5-150696 A | 6/1993 |
| JP | 09-127843 | 5/1997 |
| JP | 2001-34139 A | 2/2001 |
| JP | 2001-92322 A | 4/2001 |
| JP | 2004-252030 | 9/2004 |

* cited by examiner

*Primary Examiner*—David M Gray
*Assistant Examiner*—Ryan D Walsh
(74) *Attorney, Agent, or Firm*—Birch, Stewart, Kolasch & Birch, LLP

(57) ABSTRACT

An image forming apparatus includes a photoreceptor, a cleaning unit, an exposing unit, a developing unit, and a control section. On a circumferential surface thereof, the photoreceptor has an image area to have contact with a record medium in an image forming process, and a non-image area. The cleaning unit has a blade in contact with the image and non-image areas. The exposing unit forms an electrostatic latent image on the surface by irradiating the surface along a fast scanning direction with light modulated according to image data supplied by the control section. The data includes primary image data for modulating light to irradiate the image area with. The developing unit develops the latent image by applying developer to the surface. The control section performs an image addition processing in which secondary image data for modulating light to irradiate the non-image area with is added to the primary image data.

6 Claims, 8 Drawing Sheets

IMAGE FORMING APPARATUS THAT ADDS A TONER IMAGE TO A NON-IMAGE AREA OF A PHOTORECEPTOR TO PREVENT WARPING OF CLEANING BLADE

CROSS REFERENCE

This Nonprovisional application claims priority under 35 U.S.C. §119(a) on Patent Application No. 2004-340586 filed in Japan on Nov. 25, 2004, the entire contents of which are hereby incorporated by reference.

BACKGROUND OF THE INVENTION

The invention relates to image forming apparatuses performing an electrophotographic image forming process by forming an electrostatic latent image on a circumferential surface of a photoreceptor. The invention relates in particular to a method of preventing a cleaning blade, which is provided in a cleaning unit of the apparatuses for removing residual developer from the circumferential surface of the photoreceptor, from becoming warped.

In electrophotographic image forming apparatuses, an electrostatic latent image is formed on a circumferential surface of a photoreceptor according to image data. The electrostatic latent image is developed with developer into a developer image. Then, the developer image is transferred onto a recording medium such as a sheet of paper. In such image forming apparatuses, a charging process and an exposing process are performed in the mentioned order. In the charging process, a charging unit charges the circumferential surface of the photoreceptor so that the surface has a uniform charge distribution thereon. In the exposing process, an exposing unit irradiates the circumferential surface with image light modulated according to image data. In the exposing process, the circumferential surface of the photoreceptor is partially irradiated and discharged, with image light. Thus, an electrostatic latent image is formed on the circumferential surface, with a discharged portion as a black-image portion and a nondischarged portion as a white-image portion, respectively.

Rotation of the photoreceptor drum brings the electrostatic latent image to a developing area. To the developing area, developer is supplied from a developer sleeve provided in a developing unit. The developer consists of, or includes, toner. The toner is electrostatically attracted to the black-image portion of the electrostatic latent image because of a difference in potential between a developing bias voltage applied to the developer sleeve and a potential that the latent image has. The latent image is thus developed into a toner image.

Upon receipt of a request for image formation, sheets are fed, one at a time, from a sheet feeding section to an image forming section that includes a photoreceptor. Registration rollers are provided immediately upstream of the image forming section. A sheet is transported to a transfer area by the registration rollers so that a leading end of the sheet meets in a timely manner a leading end of a toner image formed on the circumferential surface of the photoreceptor. In the transfer area, the circumferential surface and a transferring unit faces each other. In the transfer area, the transferring unit applies a voltage opposite in polarity to a charge of the toner, so that the toner image is transferred onto the sheet.

In the transfer process as described above, toner that forms the toner image is not all transferred from the circumferential surface of the photoreceptor to the sheet. 5 to 15 percent of the toner remains on the circumferential surface. 100% transfer efficiency is not obtained because some of the toner is oppositely charged and because some of the toner, once transferred to the sheet, is transferred back to the photoreceptor when the sheet is separated from the photoreceptor.

Since the photoreceptor is rotated, image forming processes are performed numerous times on the circumferential surface of the photoreceptor. If an image forming process is performed with residual toner remaining on the circumferential surface, the circumferential surface is prevented from being uniformly charged in the charging process. Thus, residual toner contributes to poor image quality. In view of the foregoing, a cleaning unit is provided downstream of the transfer area in order to remove residual toner from the circumferential surface of the photoreceptor.

The cleaning unit usually includes a blade and a screw. The blade, which is in contact with the circumferential surface of the photoreceptor, is provided for scraping off residual toner into a toner collecting portion. The screw is provided for blowing away the residual toner as scraped off. The blade is usually made of hard rubber. The blade is pressed against the circumferential surface of the photoreceptor at a predetermined pressure. Stick-slip motions of the blade caused by rotation of the photoreceptor serve to flick the residual toner off the circumferential surface into the toner collecting portion. The blade is in contact at an edge thereof with the approximately full width of the circumferential surface along a fast scanning direction, i.e., a direction perpendicular to a direction in which the circumferential surface moves.

If a sheet being transported has a smaller length than the width of the photoreceptor along the fast scanning direction, the contact edge of the blade is more likely to be dragged in the direction in which the circumferential surface moves, so that the blade is more likely to become warped.

Residual toner remains on the image area of the circumferential surface, where a sheet faces the photoreceptor, after the transfer process is completed. A toner particle has mobility and also has a larger diameter than a water molecule. The blade has toner adhering to a contact edge thereof, thereby being prevented from becoming warped despite a high water content in the air.

In contrast, there is no residual toner on a non-image area of the circumferential surface where a sheet does not face the photoreceptor and thus a toner image is not formed. Accordingly, the high water content in the air renders the contact edge less likely to slip on the circumferential surface, particularly in a situation in which toner has not been present in the non-image area in consecutive image forming processes. In such a situation, vibration of the blade caused by rotation of the photoreceptor causes a contact-edge side of the blade to be dragged in the direction in which the circumferential surface of the photoreceptor is rotated, so that the blade becomes warped.

To deal with the foregoing problem, JP H05-150696 A discloses an image forming apparatus in which a blade provided in a cleaning unit is pressed against a circumferential surface of a photoreceptor at an appropriate pressure (torque) such as to prevent the blade from becoming warped. In an image forming apparatus disclosed by JP H01-229281 A, a black solid image is formed across the full width of a circumferential surface of a photoreceptor. The blade has contact with the solid image, so that toner adheres to the full width of a contact edge of the blade. The blade is thus prevented from becoming warped.

In the apparatus as disclosed by JP H05-150696 A, the blade is prevented from becoming warped, by setting appropriate torque for a material thereof according to prestored information on torque setting. It is impossible that the prestored information covers all of diverse materials, and thus a blade of a novel material may not be prevented from becoming warped. If the blade changes in properties over time, furthermore, appropriate torque to be applied to the blade may also change. Accordingly, it is difficult to ensure that the blade is prevented from becoming warped for a long time period.

The apparatus disclosed by JP H01-229281 A has the following problems. Forming a black solid image across the full width of the circumferential surface involves consumption of a large amount of toner, thereby causing an increase in running cost. Also, toner as collected has to be frequently removed from the apparatus. Such frequent toner removal prevents the apparatus from operating efficiently.

It is a feature of the invention to provide an image forming apparatus configured to prevent a blade from becoming warped, without causing an increase in running cost or in frequency of maintenance, by additionally forming on a circumferential surface of a photoreceptor a toner image of low density that is not transferred to a record medium so that toner constantly adheres to an edge of the blade.

SUMMARY OF THE INVENTION

An image forming apparatus of the invention includes a photoreceptor, a cleaning unit, an exposing unit, a developing unit, and a control section. The photoreceptor has an image area and a non-image area formed on a circumferential surface thereof. The image area has contact with a record medium in an image forming process. The cleaning unit has a blade positioned so as to be in contact with the image area and the non-image area. The exposing unit forms an electrostatic latent image on the circumferential surface by irradiating the circumferential surface along a fast scanning direction with light modulated according to image data. The image data includes primary image data that is used for modulating light with which to irradiate the image area. The developing unit develops the electrostatic latent image by applying developer to the circumferential surface. The control section supplies the image data to the exposing unit. The control section performs an image addition processing in which secondary image data is added to the primary image data. The secondary image data is used for modulating light with which to irradiate the non-image area.

DETAILED DESCRIPTION OF THE INVENTION

Figure 1:
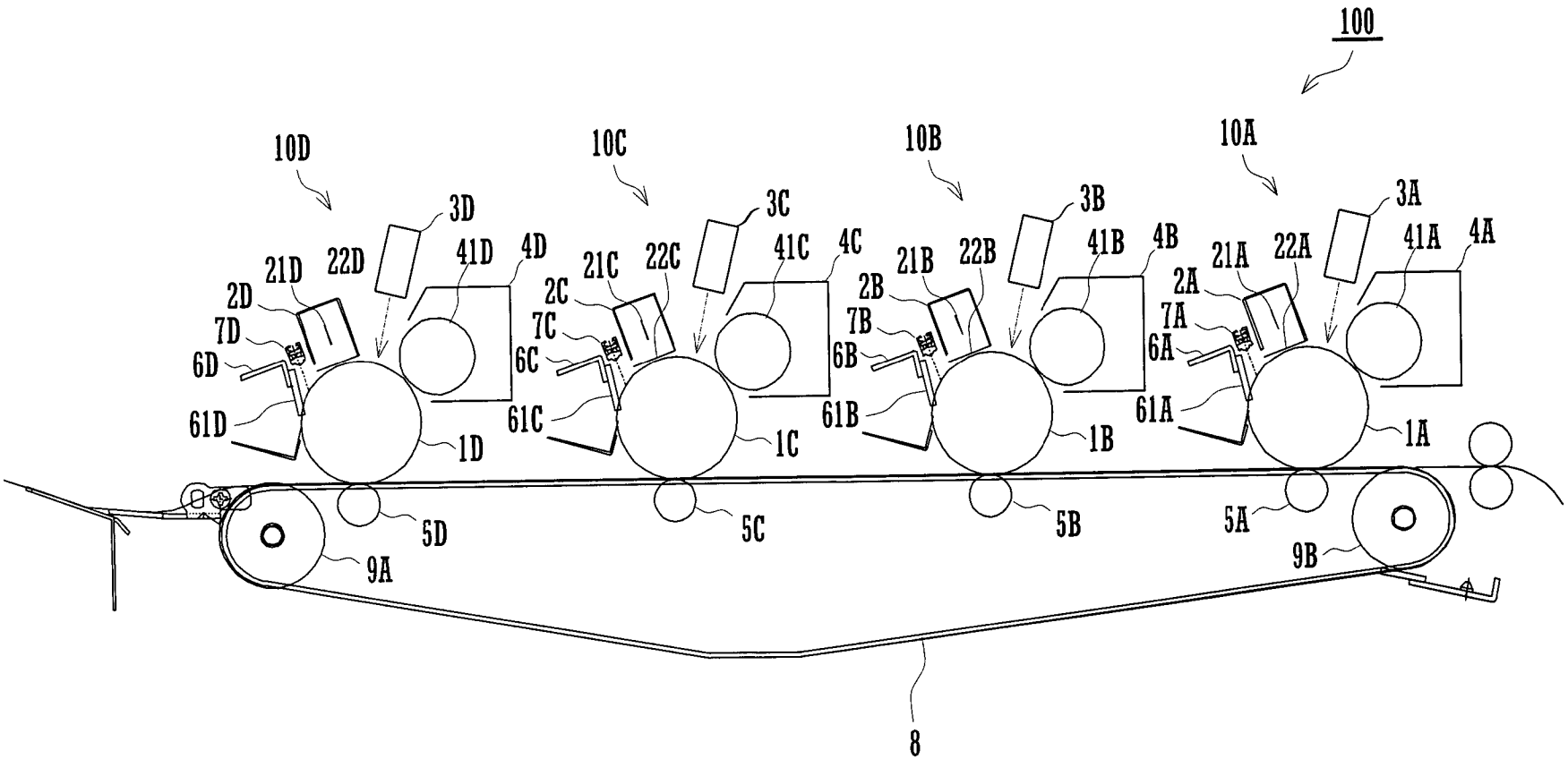
FIG. 1 is a diagram illustrating a configuration of an image forming section provided in an image forming apparatus according to an embodiment of the invention.

With reference to the accompanying drawings, an image forming apparatus according to an embodiment of the invention will be described in detail below. FIG. 1 is a diagram illustrating a configuration of an image forming section provided in the image forming apparatus. In an image forming section 100 of the image forming apparatus, image forming stations 10A, 10B, 10C, and 10D are arranged in alignment along a direction in which a sheet as a recording medium is transported, which is hereinafter referred to as the sheet transport direction. The image forming stations 10A, 10B, 10C, and 10D form images of yellow, magenta, cyan, and black colors, respectively. The image forming stations 10A, 10B, 10C, and 10D are identical in configuration to one another, but are different from one another in color of toner used for image formation therein.

A transferring belt 8 is provided below the image forming stations 10A, 10B, 10C, and 10D. The transferring belt 8 is mounted on a driving roller 9A and a driven roller 9B. The transferring belt 8, which is an endless belt, travels in a loop. Onto a surface of an upper portion thereof, the transferring belt 8 electrostatically attracts a sheet fed from a not-shown sheet feeding section, thereby transporting the sheet in the predetermined sheet transport direction.

For description of the configurations of the image forming stations 10A to 10D, the image forming station 10A is taken up below. The image forming station 10A has a photoreceptor drum 1A supported rotatably. The photoreceptor drum 1A corresponds to the photoreceptor of the invention. Around the photoreceptor drum 1A, a charging device 2A, an exposing unit 3A, a developing unit 4A, a transferring roller 5A, a cleaning unit 6A, and a discharging device 7A are arranged in the mentioned order along a direction in which the photoreceptor drum 1A is rotated.

The charging device 2A, which corresponds to the charging unit of the invention, charges a circumferential surface of the photoreceptor drum 1A so that the surface has a uniform charge distribution thereon. The charging device 2A includes a needle electrode 21A and an MC grid 22A. The needle electrode 21A functions as a main charging member. The MC grid 22A includes a mesh of metal such as stainless steel. The MC grid 22A is positioned between the needle electrode 21A and the photoreceptor drum 1A. The photoreceptor drum 1A has a constant circumferential potential maintained by applying voltage to the needle electrode 21A and the MC grid 22A.

The exposing unit 3A irradiates the circumferential surface of the photoreceptor drum 1A with light that is modulated according to yellow color image data supplied from a not-shown control section, thereby forming an electrostatic latent image on the circumferential surface of the photoreceptor drum 1A. The developing unit 4A stores therein yellow color developer to be fed to the circumferential surface of the photoreceptor drum 1A through a developing roller 41A. The developer consists of toner and carrier, and only toner, ideally, is attracted to the circumferential surface of the photoreceptor drum 1A. Thus, the electrostatic latent image is developed into a yellow toner image.

The transferring roller 5A is in contact with the circumferential surface of the photoreceptor drum 1A, with the transferring belt 8 and a sheet sandwiched therebetween. The transferring roller 5A produces a transferring electric field with the circumferential surface of the photoreceptor drum 1A, thereby transferring the toner image from the circumferential surface to a surface of a sheet.

The cleaning unit 6A has a blade 61A. The blade 61A has an edge in contact with the circumferential surface of the photoreceptor 1A at a position downstream of a transfer area where the transferring roller 1A faces the photoreceptor drum 1A. Hereinafter referred to as residual toner is toner that is not transferred to a sheet in a transfer process and therefore remains on the circumferential surface of the photoreceptor drum 1A. The residual toner is scraped off the circumferential surface with the blade 61A. Most of the residual toner is collected into a housing of the cleaning unit 6A, with a small amount thereof adhering to the edge of the blade 61A. After the transfer process is completed, the discharging device 7A irradiates the entire circumferential surface of the photoreceptor drum 1A with light, thereby causing the surface to lose a residual charge.

In the image forming station 10B, an exposing unit 3B is supplied with magenta color image data, and the developing unit 4B stores therein magenta color toner. In the image forming station 10C, an exposing unit 3C is supplied with cyan color image data, and the developing unit 4C stores therein cyan color toner. In the image forming station 10D, an exposing unit 3D is supplied with black color image data, and the developing unit 4D stores therein black color toner.

While transporting a sheet, the transferring belt 8 passes between the photoreceptor drum 1A and the transferring roller 5A, between a photoreceptor drum 1B and a transferring roller 5B, between a photoreceptor drum 1C and a transferring roller 5C, and between a photoreceptor drum 1D and a transferring roller 5D, in the mentioned order. During the transport, yellow, magenta, cyan, and black toner images are sequentially transferred and accumulated onto the sheet, so that a full-color image is formed on the sheet.

In monochromatic image formation, in contrast, an image forming operation is performed only in the image forming station 10D. In the image forming stations 10A to 10C, the transferring rollers 5A to 5C are drawn apart from the respective circumferential surfaces of the photoreceptor drums 1A to 1C, respectively.

Figure 2:
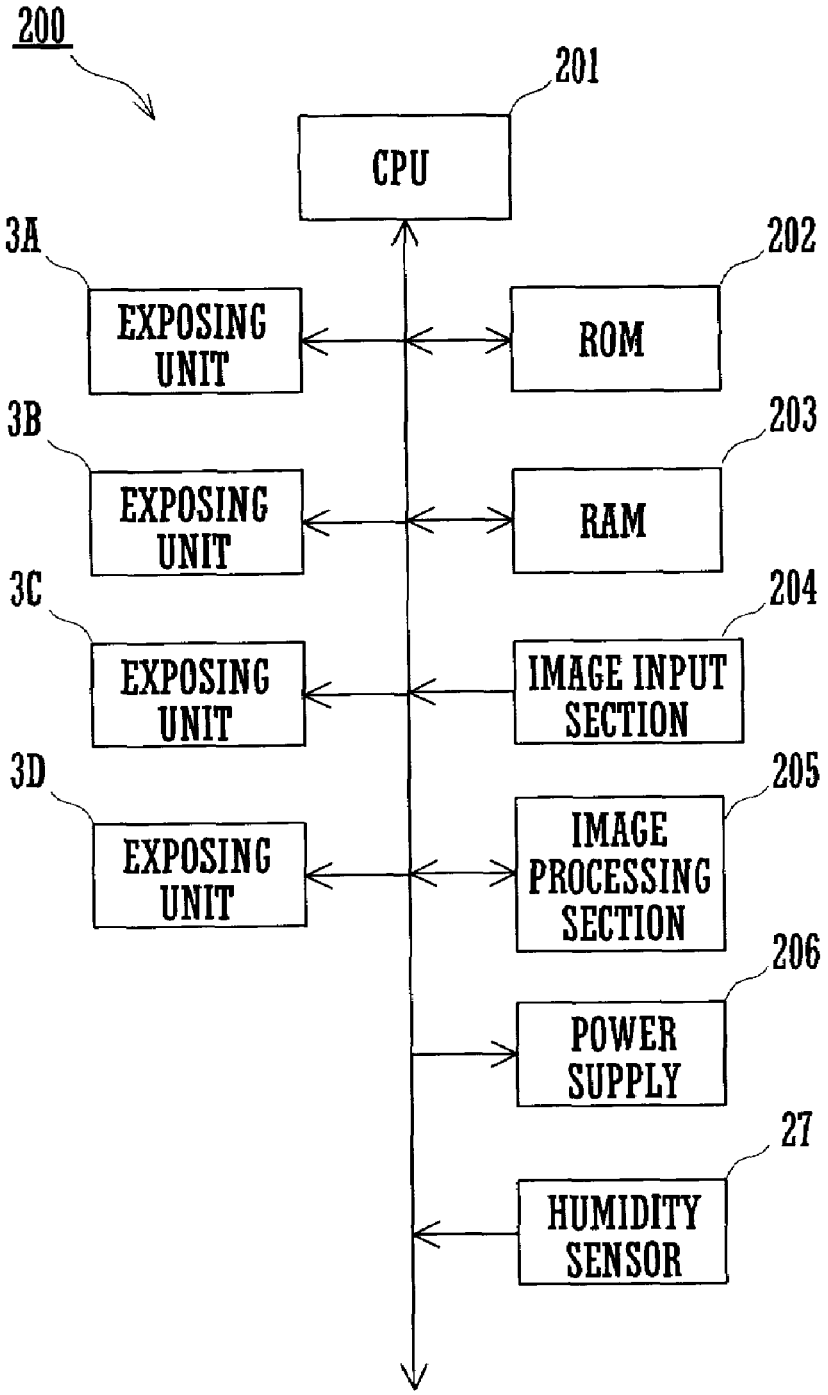
FIG. 2 is a block diagram illustrating a configuration of a control section provided in the image forming apparatus.

FIG. 2 is a block diagram illustrating a configuration of the control section 200. The control section 200 includes a CPU 201 with a ROM 202 and a RAM 203. The control section 200 also includes an image input section 204, an image processing section 205, a power supply 206 for the charging devices 6A to 6D, the exposing units 3A to 3D, and a humidity sensor 27, all connected to the CPU 201. The CPU 201 has overall control of the components as connected thereto, by executing programs stored in the ROM 202. The CPU 201 stores input or output data in a memory area within the RAM 203.

The image processing section 205 performs image processing of image data input from external devices. The CPU 201 sends the image data as processed, to the exposing units 3A to 3D. The power supply 206 applies voltage to each pair of (i) the needle electrode 21A and the MC grid 22A, (ii) a needle electrode 21B and a MC grid 22B, (iii) a needle electrode 21C and a MC grid 22C, and (iv) a needle electrode 21D and a MC grid 22D. The humidity sensor 27 detects humidity in and around the image forming section 100, which is to be referred to merely as the internal humidity.

Figure 3:
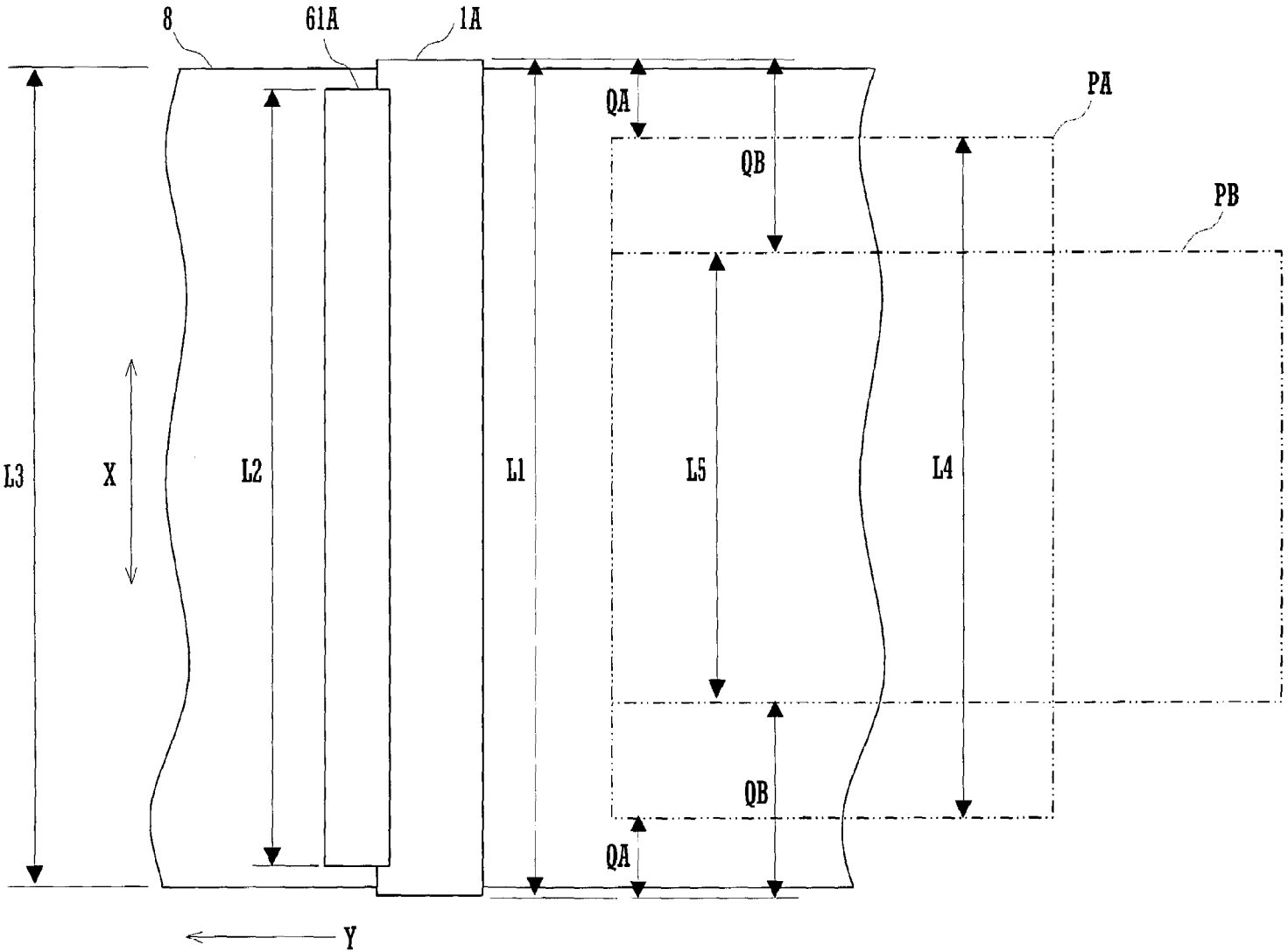
FIG. 3 is a diagram illustrating an image area and a non-image area of a circumferential surface of a photoreceptor provided in the image forming apparatus.

FIG. 3 is a diagram illustrating an image area and a non-image area of the circumferential surface of the photoreceptor drum 1A. In the present embodiment, the photoreceptor drum 1A has a diameter of 40 mm and a length L1 of 332 mm as measured along a fast scanning direction X that is perpendicular to a sheet transport direction Y. The blade 61A has a length L2 of 327 mm as measured along the fast scanning direction. The transferring belt 8 has a width L3 of 330 mm as measured along the fast scanning direction.

A sheet PA of size A4 is transported with a longitudinal direction thereof parallel to the fast scanning direction. The sheet PA has a full length L4 of 298 mm. The photoreceptor drum 1A comes into contact with the full length L4 of the sheet PA. Thus, non-image areas QA each having a full length of 17 mm are formed on both ends of the circumferential surface of the photoreceptor drum 1A in the fast scanning direction. The blade 61A has contact with a partial length of 14.5 mm of each of the non-image areas QA along the fast scanning direction.

A sheet PB of size A4 is transported with a longitudinal direction thereof parallel to the sheet transport direction. The sheet PB has a full length L5 of 210 mm. The photoreceptor drum 1A comes into contact with the full length L5 of the sheet PB. Thus, non-image areas QB each having a full length of 61 mm are formed on both ends of the circumferential surface of the photoreceptor drum 1A in the fast scanning direction. The blade 61A has contact with a partial length of 58.5 mm of each of the non-image areas QB along the fast scanning direction.

Hereinafter referred to as an image area is an area of the circumferential surface of the photoreceptor drum 1A where a sheet comes into contact with the photoreceptor drum 1A. A toner image is formed in the image area. Accordingly, when the image area is sufficiently wide to cover a major part of the length L1, as with the sheet PA, residual toner is always present between the circumferential surface and an approximately full length of the blade 61A. The residual toner reduces friction between the blade 61A and the photoreceptor drum 1A, thereby rendering the blade 61A less likely to become warped.

In contrast, a toner image is not formed in the non-image areas. Accordingly, when the image area is so narrow as to cover a minor part of the length L1, as with the sheet PB, the blade 61A comes into contact with the non-image areas. Thus, residual toner is absent between the circumferential surface and a comparatively major portion of the blade 61A. The absence of residual toner increases friction between the blade 61A and the photoreceptor drum 1A, thereby rendering the blade 61A more likely to become warped. In particular when image forming processes are performed consecutively on a plurality of sheets, the blade 61A repeatedly contacts the non-image area of the photoreceptor drum 1A, thereby scraping off the residual toner that is present between the photoreceptor drum 1A and the blade 61A. Thus, the blade 61A is more likely to become warped.

Figure 4:
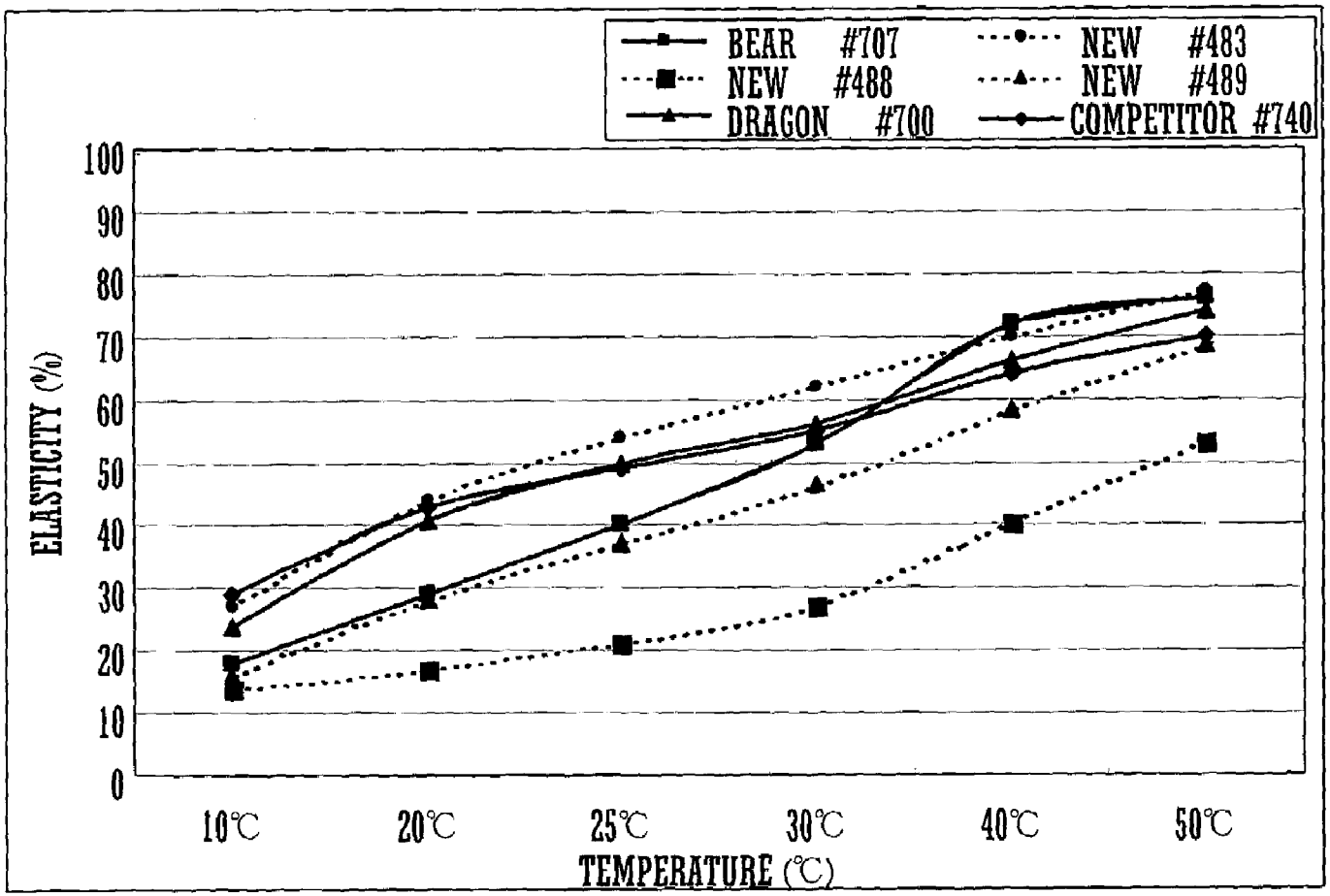
FIG. 4 is a table indicating a relationship between temperature and elasticity of hard rubber as a material of a blade.

Also, an increase in internal humidity renders the contact edge of the blade 61A less likely to slip on the circumferential surface. While high humidity usually accompanies high temperature, the blade 61A consists essentially of hard rubber that becomes softened and more elastic with an increase in environmental temperature, as shown in FIG. 4. For the reasons as presented above, the blade 61A is more likely to become warped at high humidity.

When image forming processes are to be performed consecutively on small-size sheets that are small in length along the fast scanning direction with the internal humidity at a level higher than a reference level, the CPU 201 performs image addition processing, i.e., forms toner images in non-image areas of the photoreceptor drum 1A.

Similar processes to those as described above are performed in the image forming stations 10B to 10D.

Figure 5:
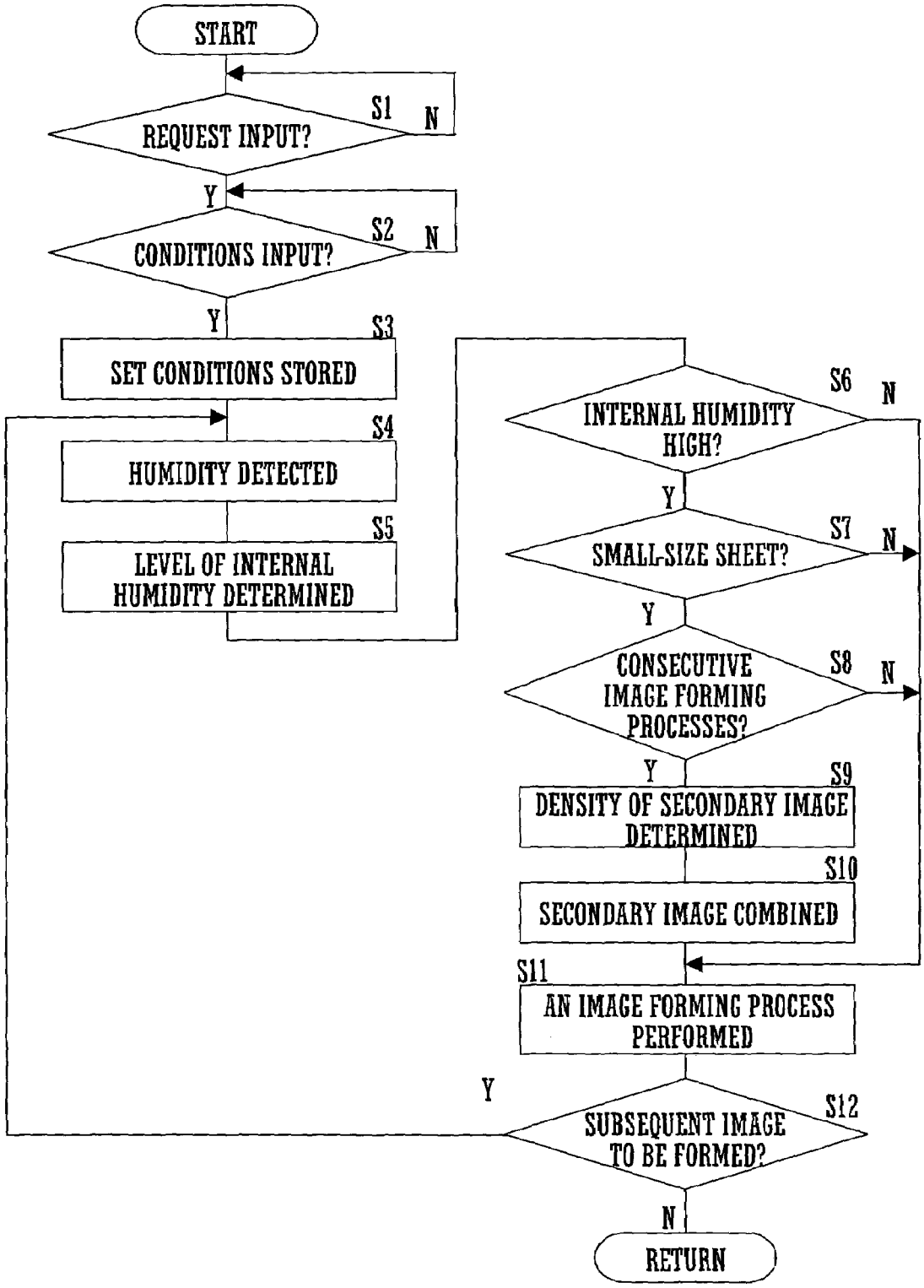
FIG. 5 is a flowchart illustrating steps of a process performed by the control section.

FIG. 5 is a flowchart illustrating steps of processing executed by the control section. When the image forming apparatus is turned on, the CPU 201 goes through a warm-up process and then waits for input of an image forming request (S1). When an image forming request is input from a not-shown external device, the CPU 201 receives input for setting conditions such as sheet size, number of sheets for image formation to be performed to, or image density (S2). Then, the CPU 201 stores the set conditions in the RAM 203 (S3). It is to be noted that image data input together with the image forming request is stored in an image memory.

Figure 6:
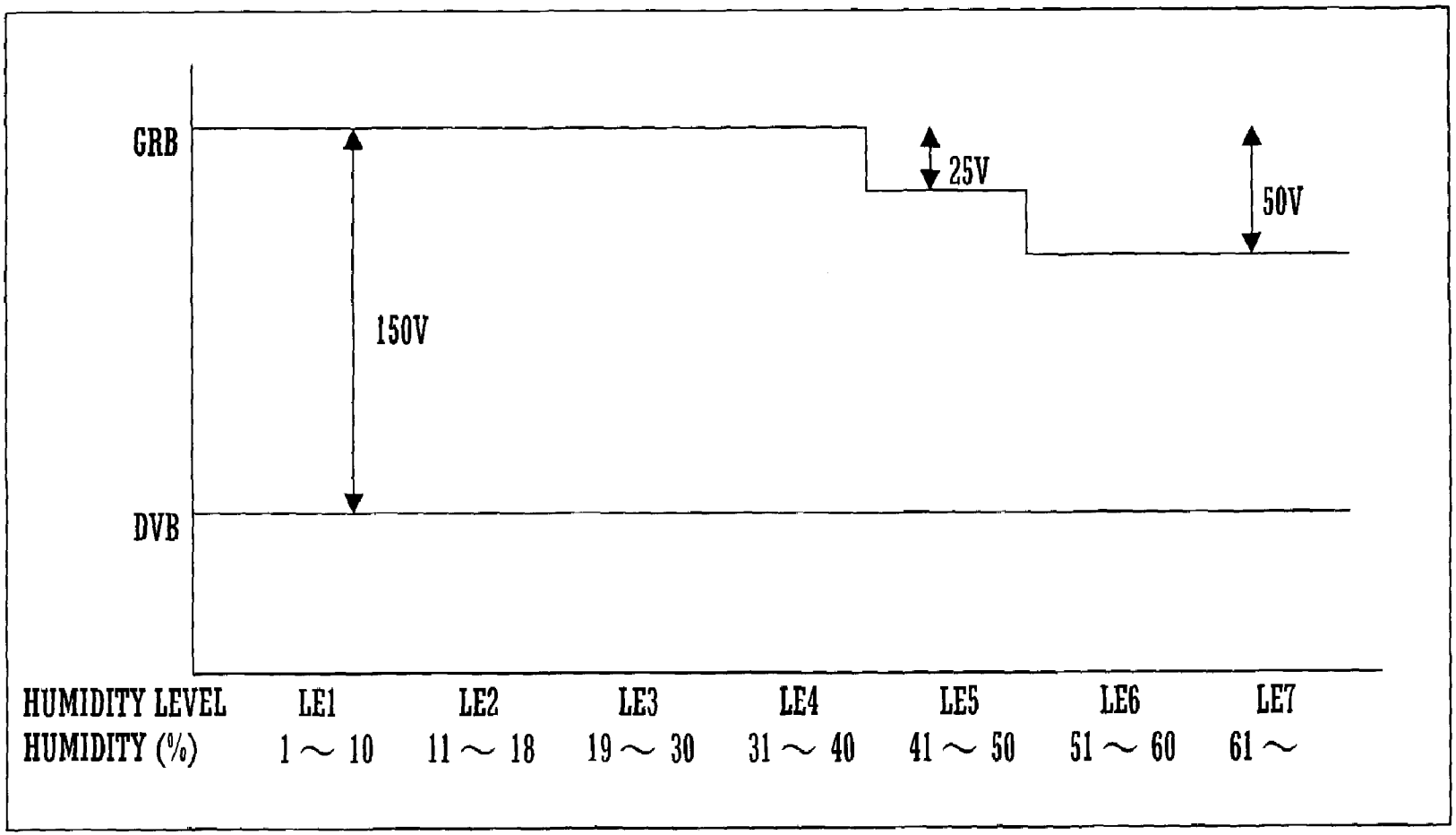
FIG. 6 is a graph indicating respective relationships between humidity levels and grid bias voltage GRB and between the humidity levels and developing bias voltage DVB.

The CPU 201 reads a detection signal output by the humidity sensor 27 (S4), and determines at what level the internal humidity is (S5). The ROM 202 stores therein a lookup table that is used to classify the internal humidity into several predetermined levels, for example as shown in FIG. 6. The CPU 201 determines whether the internal humidity falls into either of levels LE5 to LE7, i.e., whether the internal humidity is high (S6). When there is high humidity within the apparatus, the CPU 201 determines whether a sheet used for image formation is a small-size sheet that is smaller in length along the fast scanning direction than a sheet of maximum transportable size. When the small-size sheet is to be used for image formation, the CPU 201 determines whether image forming processes are to be performed consecutively on a plurality of sheets (S8).

When image forming processes are to be performed consecutively on a plurality of small-size sheets with the internal humidity at a high level, the CPU 201 determines density of a secondary image to be formed in a non-image area, depending on the levels of the internal humidity (S9). The ROM 202 stores therein a lookup table where the levels of the internal humidity are associated with densities of secondary image. The CPU 201 refers to the lookup table in order to determine the density of secondary image. Further, the CPU 201 adds image data for the secondary image, i.e., secondary image data, of determined density to image data for a primary image to be formed in an image area, i.e., primary image data (S10). The addition of the primary and secondary image data are performed with regard to respective colors—yellow, cyan, magenta, and black. It is to be noted that the primary image data is stored in the image memory. The CPU 201 sends the respective color image data as added, to the exposing units 3A to 3D, so that an image forming process is performed (S11).

If determinations are made in the respective steps S6 to S8 that (i) the internal humidity is not high; (ii) a small-size sheet is not to be used for image formation; and (iii) image forming processes are not to be performed consecutively, the CPU 201 supplies the primary image data as stored in the image memory to each of the exposing units 3A to 3D, without adding the secondary image data to the primary image data (S11). An image forming process is thus performed.

When an image forming process is completed on a sheet, the CPU 201 determines whether there is an image to be formed on a subsequent sheet (S12). When an image is to be subsequently formed, the CPU 201 returns to step S4. When no image is to be formed, the CPU 201 returns to a standby state in which the CPU 201 waits for a request for image formation.

As described above, the CPU 201 performs the image addition processing when image forming processes are to be performed consecutively on small-size sheets that are small in length along the fast scanning direction with the internal humidity at a level higher than a reference level. More specifically, the CPU 201 adds the secondary image data to the primary image data. It is to be noted that respective image areas on the photoreceptor drums 1A to 1D are exposed to light that is modulated according to the primary image data, and that respective non-image areas on the photoreceptor drums 1A to 1D are exposed to light that is modulated according to the secondary image data. Thus, secondary images of densities corresponding to levels of internal humidity are formed on the respective non-image areas on the photoreceptor drums 1A to 1D. Toner is constantly present between the photoreceptor drums 1A to 1D and the blades 61A to 61D, respectively, thereby preventing the blades 61A to 61D from becoming warped.

Since the secondary images are formed only on the non-image areas, wasteful consumption of a large amount of toner is prevented. Accordingly, the blades 61A to 61D are prevented for a long time period from becoming warped, without a significant increase in running cost or frequency of maintenance.

Also, as described above, the densities of secondary images are changed depending on the levels of the internal humidity. Accordingly, an excessive amount of toner does not adhere to the respective non-image areas of the photoreceptor drums 1A. A significant increase in toner consumption is thus prevented. Further, the charging, developing, and cleaning processes are performed evenly across each of the photoreceptor drums 1A to 1D. Thus, each of the photoreceptor drums 1A to 1D deteriorates evenly thereacross. Accordingly, long-term use does not cause each of the photoreceptor drums 1A to 1D to have variation of photoreceptivity thereacross.

The density of the secondary image can be changed by varying halftone gradation thereof. Alternatively, the secondary image consists of a plurality of lines, and the density of the secondary image is changed by narrowly or widely spacing the lines depending on the levels of the internal humidity. When the lines are oriented parallel to the fast scanning direction, there is a possibility that an excessive amount of toner adheres to each of the blades 61A to 61D across a predetermined length thereof at a time, thereby causing the blades 61A to 61D to become warped. Therefore, it is preferable that the lines are oriented at an angle with respect to the fast scanning direction so that an excessive amount of toner does not adhere to each of the blades 61A to 61D at a time.

Next, described below is a process in which the secondary image is formed by producing a fog, i.e., a smudge of toner, in the non-image area of each of the photoreceptor drums 1A to 1D. The process serves to substitute for steps S9 and S10 as in FIG. 5.

Generally, a fog is caused by various factors such as: surface potential of a photoreceptor charged by a charging unit; a variation in potential across the photoreceptor as charged; a developing bias; and a charge produced by friction between toner particles. A long-term use causes a photoreceptor to become less photoreceptive, thereby causing toner to be more likely to remain on a circumferential surface of the photoreceptor. That is, a fog is more likely to occur.

In view of the foregoing, the CPU 201 is configured to vary a grid bias voltage GRB depending on the levels of the internal humidity, as shown in FIG. 6, when image forming processes are to be performed consecutively on small-size sheets that are small in length along the fast scanning direction. The grid bias voltage GRB is a voltage applied to the MC grids 22A to 22D in the charging devices 21A to 21D. With the internal humidity at the levels LE1 to LE 4, referring to FIG. 6, a predetermined amount of grid bias voltage GRB is applied to the grids 22A to 22D so that there is a potential difference $\Delta V$ of for example 150 V between the grid bias voltage GRB and a developing bias voltage DVB. The developing bias voltage is a voltage to be applied to the developing rollers 41A to 41D.

With the internal humidity at the levels LE5 to LE7, the potential difference $\Delta V$ is reduced by decreasing the grid bias voltage GRB so that the fog is more likely to occur. More specifically, the grid bias voltage GRB is decreased by 25 V at the level LE5, whereas the voltage GRB is decreased by 50 V at the levels LE6 and LE7. Consequently, a larger amount of toner is attracted to the photoreceptor drums 1A to 1D than before the grid bias voltage GRB is decreased, thereby allowing a fog to occur in the respective non-image areas of the photoreceptor drums 1A to 1D.

Since the respective non-image areas have no contact with a sheet, toner that adheres to the non-image areas remains as residual toner on the circumferential surfaces of the photoreceptor drums 1A to 1D after a transfer process is completed. Thus, toner is present between the blades 61A to 61D and the respective non-image areas, thereby preventing the blades 61A to 61D from becoming warped.

However, the fog occurs not only in the respective non-image areas, but also in the respective image areas of the photoreceptor drums 1A to 1D. If an image forming process is performed with only the grid bias voltage GRB changed, not only a toner image formed in each of the image areas, but also a fog that occurs therein is transferred onto a sheet, so that the fog appears on the sheet. This causes an image of poor quality to be formed on the sheet.

Described below is a degree of occurrence of fog on a sheet as measured with a Hunter calorimeter. The degree is indicated by a measured value BG. With the photoreceptor drums 1A to 1D and the image forming section 100 including developer in initial states thereof, the measured value BG falls within a range of approximately 0.02 to approximately 0.1. Shortly before the end of life thereof, however, the photoreceptor drums 1A to 1D and the developer deteriorate, thereby causing a higher degree of occurrence of fog. Generally, the lower the degree of fog occurrence is, the higher quality an image as formed is. In the image forming apparatus, an allowable range of the measured value BG is from approximately 1.5 to approximately 2.0 for a sheet with an image formed on a single side, and from approximately 2.5 to approximately 3.0 for a sheet with images formed on both sides. The measured value BG is higher for a sheet with images formed on both sides because fogs on both sides of the sheet are measured.

Figure 7:
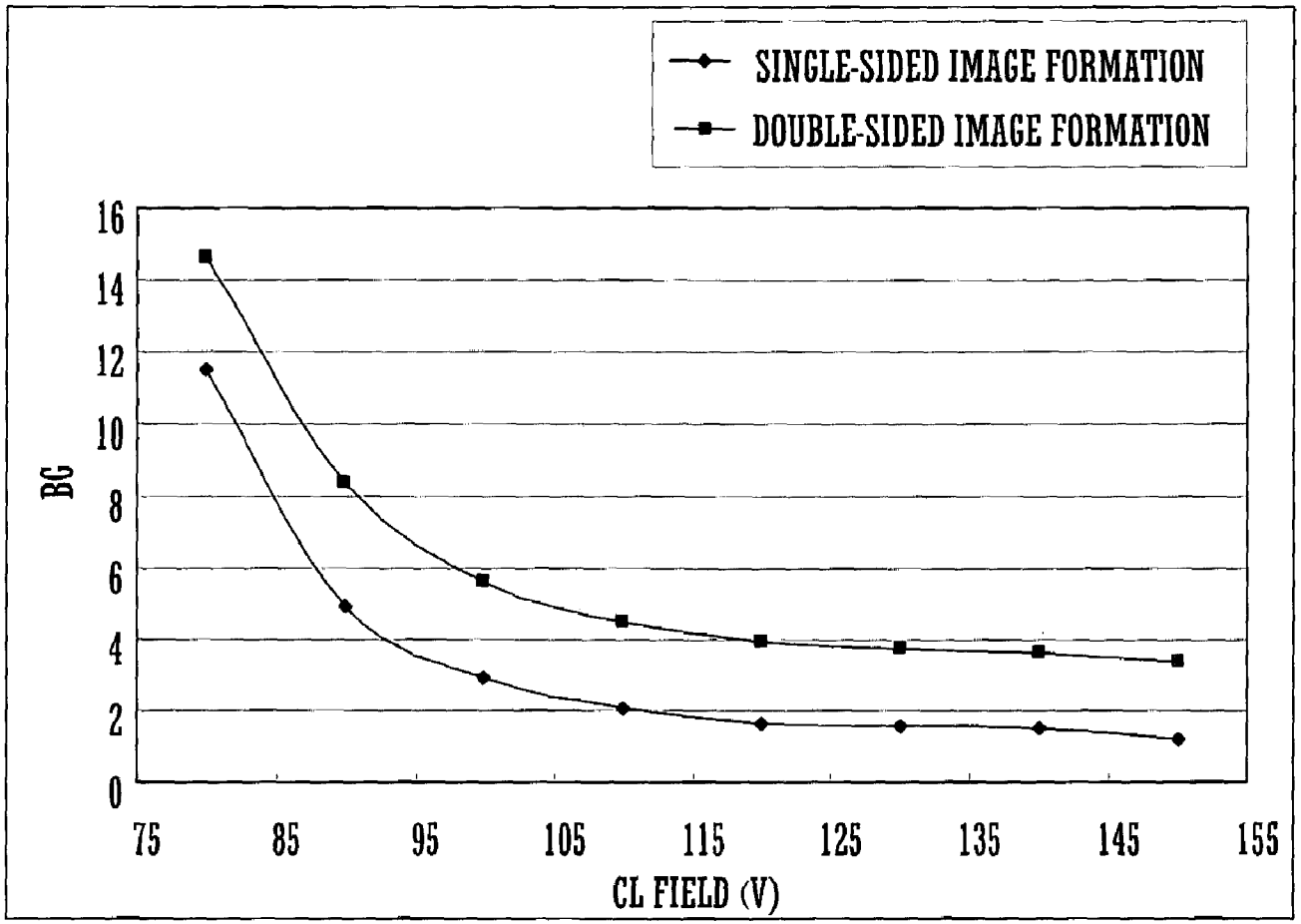
FIG. 7 is a graph indicating a relationship between a measured value BG that indicates a degree of occurrence of fog, and a CL field that is a potential difference between the grid bias voltage GRB and the developing bias voltage DVB.

A potential difference between the grid bias voltage GRB and the developing bias voltage DVB is hereinafter referred to as a CL field. A relationship between the CL field and the measured value BG is as shown in FIG. 7. As is clear from the figure, the measured value BG is above the allowable range when the internal humidity is at the levels LE6 or higher and the CL field is 100 V in the image addition processing as described above. Also, even when the measured value BG falls within the allowable range, the value BG is preferably minimized for better image quality.

Figure 8:
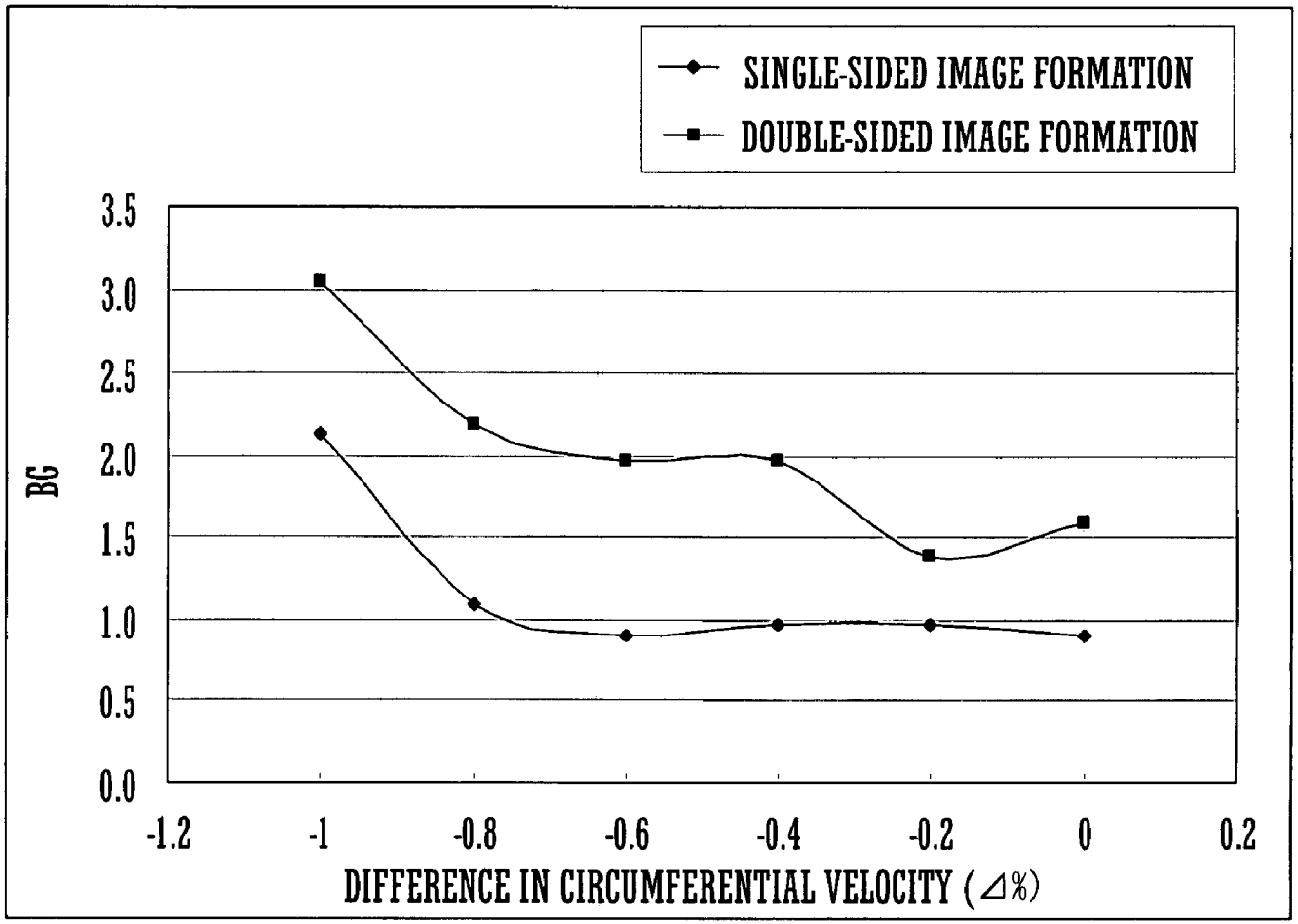
FIG. 8 is a graph indicating a relationship between the measured value BG and a difference in circumferential velocity between a photoreceptor drum and a transferring roller.

As shown in FIG. 8 is a relationship between the measured value BG and a difference in circumferential velocity between the photoreceptor drums 1A to 1D and the transferring rollers 5A to 5D. According to the relationship, the CPU 201 decreases the grid bias voltage GRB and controls the respective circumferential velocities of the photoreceptor drums 1A to 1D and the transferring rollers 5A to 5D. As is clear from FIG. 8, the smaller the difference in circumferential velocity is, the smaller the measured value BG becomes. Accordingly, the CPU 201 controls the photoreceptor drums 1A to 1D and the transferring rollers 5A to 5D to have an equal circumferential velocity when the image addition processing is performed.

In the image addition processing, thus, the grid bias voltage GRB is decreased so that a larger amount of toner adheres to the photoreceptor drums 1A to 1D, while an excessive amount of toner is not transferred from the respective image areas of the photoreceptor drums 1A to 1D to a sheet. Accordingly, with a fog prevented from occurring on a sheet, the toner that adheres to the non-image areas of the photoreceptor drums 1A to 1D prevents the blades 61A to 61D from becoming warped.

The blades 61A to 61D are prevented from becoming warped by a fog generated across each of the photoreceptor drums 1A to 1D. Accordingly, wasteful consumption of a large amount of toner is prevented. Thus, the blades 61A to 61D are prevented for a long time period from becoming warped, without a significant increase in running cost or frequency of maintenance.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus, comprising:

a photoreceptor drum having an image area and a non-image area formed on a circumferential surface thereof, the image area having contact with a recording sheet in an image forming process, the recording sheet moving in a sheet transport direction;

a cleaning unit that has a blade positioned so as to be in contact with the image area and the non-image area of the photoreceptor drum;

an exposing unit for forming an electrostatic latent image on the circumferential surface of the photoreceptor drum by irradiating the circumferential surface along a fast scanning direction with light modulated according to image data, the image data including primary image data that is used for modulating light with which to irradiate the image area;

a developing unit for developing the electrostatic latent image by applying developer to the circumferential surface of the photoreceptor drum; and a control section for supplying the image data to the exposing unit, wherein the control section performs an image addition processing in which secondary image data is added to the primary image data, the secondary image data being used for modulating light with which to irradiate the non-image area, the secondary image data is formed on the non-image area on the circumferential surface of the photoreceptor drum, the non-image area being an area in which the circumferential surface of the photoreceptor drum does not have contact with the recording sheet while the recording sheet, moving in the sheet transport direction, has contact with the circumferential surface of the photoreceptor drum and is laterally outside of an area of contact with the recording sheet in the fast scanning direction and does not include a non-contact area between recording sheets, density of a secondary image in the non-image area corresponding to the secondary image data is determined based upon humidity level of the image forming apparatus, and the developer corresponding to the primary image data is transferred from the circumferential surface of the photoreceptor drum to the recording medium in a transfer process while the developer corresponding to the secondary image data remains as residual toner on the circumferential surface of the photoreceptor drum after the transfer process.

2. The image forming apparatus according to claim 1, further comprising a sensor for detecting environmental conditions inside the apparatus, wherein the control section performs the image addition processing when the sensor detects a humidity level higher than a reference humidity level.

3. The image forming apparatus according to claim 1, wherein the control section performs the image addition processing when a record medium to be used for image formation is smaller in length along the fast scanning direction than a record medium of maximum transportable size.

4. The image forming apparatus according to claim 1, wherein the control section performs the image addition processing when image forming processes are performed consecutively on a plurality of record media.

5. The image forming apparatus according to claim 1, further comprising a sensor for detecting environmental conditions inside the apparatus, wherein the control section adjusts the secondary image data according to a detection result of the sensor when the control section performs the image addition processing.

6. The image forming apparatus according to claim 1, further comprising a sensor for detecting environmental conditions inside the apparatus, wherein the secondary image data is data for a line image that consists of a plurality of lines, and wherein the control section changes spacing between the lines according to a detection result of the sensor.

* * * * *